United States Patent [19]

Okada

[11] Patent Number: 4,715,604

[45] Date of Patent: Dec. 29, 1987

[54] SLOT MACHINE

[75] Inventor: Kazuo Okada, Tokyo, Japan

[73] Assignee: Kabushiki Kaisha Universal, Tochigi, Japan

[21] Appl. No.: 855,414

[22] Filed: Apr. 24, 1986

[30] Foreign Application Priority Data

Apr. 30, 1985 [JP] Japan ..... 60-63157[U]

[51] Int. Cl.[4] ..... A63F 5/04

[52] U.S. Cl. ..... 273/143 R

[58] Field of Search ..... 273/138 A, 143 R, 143 A, 273/143 B, 143 C, 143 D, 143 E, 139; 222/19

[56] References Cited

U.S. PATENT DOCUMENTS

| | | | |
|---|---|---|---|
| 2,511,287 | 6/1950 | Moore | 222/19 |
| 3,138,385 | 6/1964 | Giacobello | 273/138 A |
| 3,852,576 | 12/1974 | Rudd | 273/138 A |
| 4,492,379 | 1/1985 | Okada | 273/143 R |

FOREIGN PATENT DOCUMENTS

| | | | |
|---|---|---|---|
| 2083935 | 3/1982 | United Kingdom | 273/143 R |

*Primary Examiner*—Richard C. Pinkham
*Assistant Examiner*—MaryAnn S. Lastova
*Attorney, Agent, or Firm*—Young & Thompson

[57] ABSTRACT

A slot machine which selects combinations of symbols on prize-winning lines by causing a plurality of lengthwise movable symbol rows arranged side by side, each of which comprises a plurality of kinds of symbols arranged at regular distances thereon, to move lengthwise, and then stopping each symbol row at one of the possible stop positions, in each of which it displays at least one complete symbol to a player through a window to position the symbols shown in the windows shifted lengthwise a half of the distance between the transversely adjacent symbols. When all the reels stop, a win decision is made base on the combinations of complete symbols stopping on the winning line or lines. The winning lines are therefore necessarily all diagonal.

5 Claims, 4 Drawing Figures

SLOT MACHINE

BACKGROUND OF THE INVENTION

The present invention relates to a slot machine which is adapted to display symbols on a plurality of lengthwise movable rows of symbols, with at least one complete symbol appearing in each symbol row, in a way to shift the complete symbols that are transversely adjacent to each other lengthwise a predetermined regular distance.

As is well known in the art, slot machines of the type which use either mechanical rotatable reels or a simulated video display of rotating reels on a CRT screen (hereinafter generically referred to as "reels") have a plurality of lengthwise movable series of various symbols arranged at a regular spacing on the reels. During a game, each reel is caused to rotate, and is stopped at one of its possible stop positions in each of which it displays corresponding symbols to a player through a window. When all the reels stop, a win decision is made based on the combinations of symbols stopping on the winning line or lines and, if there is a win, as many coins as the number corresponding to the kind of that win are paid out.

The above-described slot machine having, for example, three reels arranged side by side displays in its reel windows nine symbols, three for each reel, aligned in three transverse rows. Therefore, it is possible to display at most five possible prize-winning combinations of symbols, namely three transverse and two diagonal combinations of symbols.

In the above-described conventional slot machines, when each reel stops at one of the possible stop positions, the slot machine displays the same number of symbols on each reel at the same regular spacing. As a result, the conventional slot machines have no variety of prize-winning lines and cannot give players a special interest in playing games.

OBJECT OF THE INVENTION

A principal object of the present invention is, therefore, to provide a slot machine which is adapted to display symbols which are shifted lengthwise between the transversely adjacent symbols.

SUMMARY OF THE INVENTION

For achieving the above-mentioned object, the slot machine in accordance with the present invention comprises a plurality of lengthwise movable rows of symbols arranged side by side, the symbols being arranged at a regular spacing for each symbol row, and means for causing the symbol rows to move lengthwise and then stopping the same at one of their possible stop positions, thereby displaying symbols comprising at least one complete symbol for each symbol row in windows for observation in a way to shift the symbols lengthwise a half of the interval between the transversely adjacent complete symbols.

When all the symbol rows stop and a predetermined prize-winning combination of complete symbols occurs on a straight prize-winning line or lines, prizes are awarded.

According to a feature of the present invention, since the symbols transversely adjacent to each other are displayed shifted lengthwise from each other, unique prize-winning lines can be established, whereby the player can play games with a special interest which is not experienced in the conventional slot machines.

BRIEF DESCRIPTION OF THE DRAWINGS

The above and other objects and features of the present invention will be more apparent upon consideration of the following description taken in connection with the accompanying drawings, in which.

DETAILED DESCRIPTION OF THE INVENTION

Figure 1:
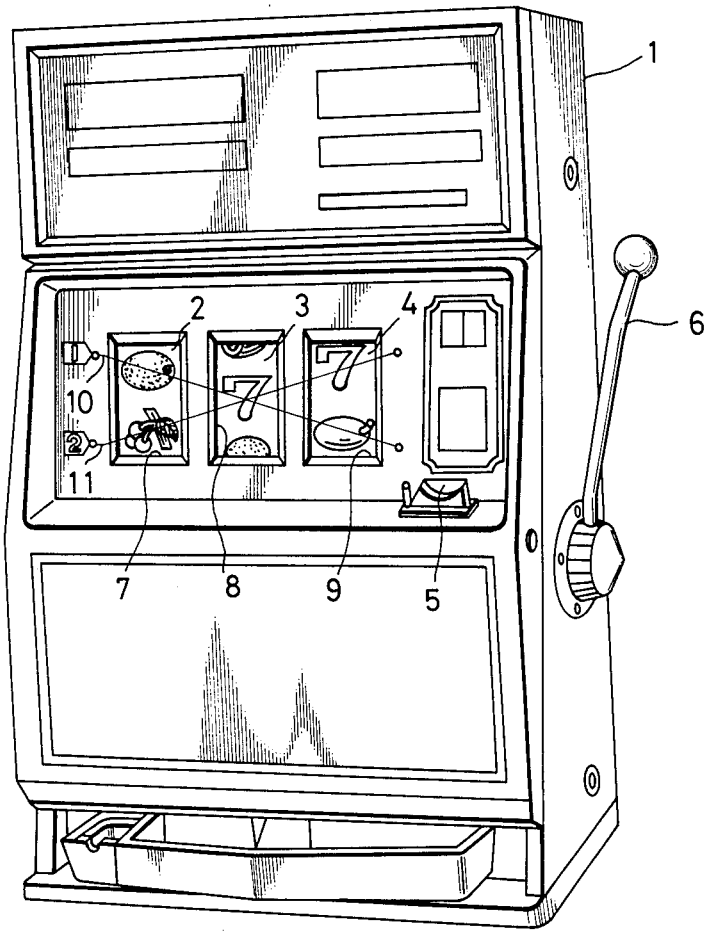
FIG. 1 is a front perspective view showing an embodiment of the slot machine in accordance with the present invention.

FIG. 1 shows an example of a slot machine according to the present invention which includes in a housing 1 a set of reels 2 to 4 having symbols arranged on the periphery at a regular spacing. The reels 2 to 4 are arranged side by side and coupled to stepping motors 24 to 26 (shown in FIG. 3) so as to rotate independently from each other.

The slot machine is played by inserting coins into a coin slot 5 and pulling a start lever 6. When the player pulls the start lever 6, the stepping motors 24 to 26 start into rotation so as to rotate the respective reels 2 to 4 simultaneously. Through respective reel windows 7 to 9, symbols on each reel 2 to 4 can be observed when the reel stops; however, this is almost impossible while the reel is moving at a high speed. After each reel 2 to 4 reaches a constant speed of rotation, each reel 2 to 4 is controlled to stop on a random basis. When each reel is thus randomly stopped, the displayed symbols on each reel 2 to 4 may be observed through the respective reel windows 7 to 9.

Specifically, two complete symbols can be observed through the reel windows 7 and 9 and one complete symbol through the reel window 8 in this embodiment, when the reels 2 to 4 are stopped. That is to say, the symbols on the reel 3 are arranged in such a way that each symbol on the reel 3 is positioned between two adjacent symbols on each of the remaining reels 2 and 4 when all the reels 2 to 4 are completely stopped.

A winning line 10, which is diagonal relative to the reel windows 7 to 9, is provided for use in common with the reel windows 7 to 9. When all the reels 2 to 4 stop as described above, a win decision is made based on the combination of symbols stopping on the winning line 10. In addition to the winning line 10, it is possible to provide another winning line 11 as shown in FIG. 1. In this way, it is possible to increase the number of effective winning lines in accordance with the number of coins inserted prior to the start of a game, for example one for one coin and two for two coins.

Figure 2:
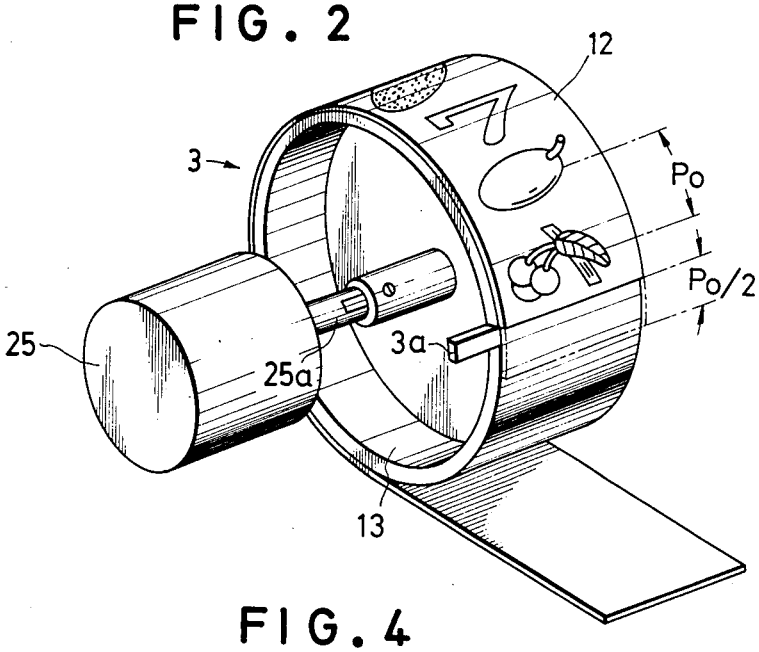
FIG. 2 is an enlarged perspective view illustrating a reel which is used in the slot machine of FIG. 1.

As shown in FIG. 2, for the purpose of the staggered arrangement of symbols on the reel 3, a strip 12 on which various kinds of symbols are arranged separated from each other by a distance Po is attached to the frame 13 of the reel 3, in such a way that the first symbol, namely a cherry in this example, is shifted a half of the distance Po from a datum lug 3*a* provided on the reel frame 13. The datum lug 3*a* is an opaque member which, as will be described in detail later, is used in order to establish a relationship between the rotated angular position of the reel and the number of pulses applied to the stepping motor. It should be noted that on each of the remaining reels 2 to 4 having the same construction as the reel 3, a strip on which various kinds of symbols are arranged separated from each other by a distance Po is attached in such a way that a first symbol is in alignment with the datum lug 2*a*, 4*a*.

Each reel 2 to 4 with the symbol strip 12 attached is so coupled to a driving shaft 24*a* to 26*a* of the respective stepping motor 24 to 26, as to maintain the relative position between the reel frame and the stepping motor.

Figure 3:
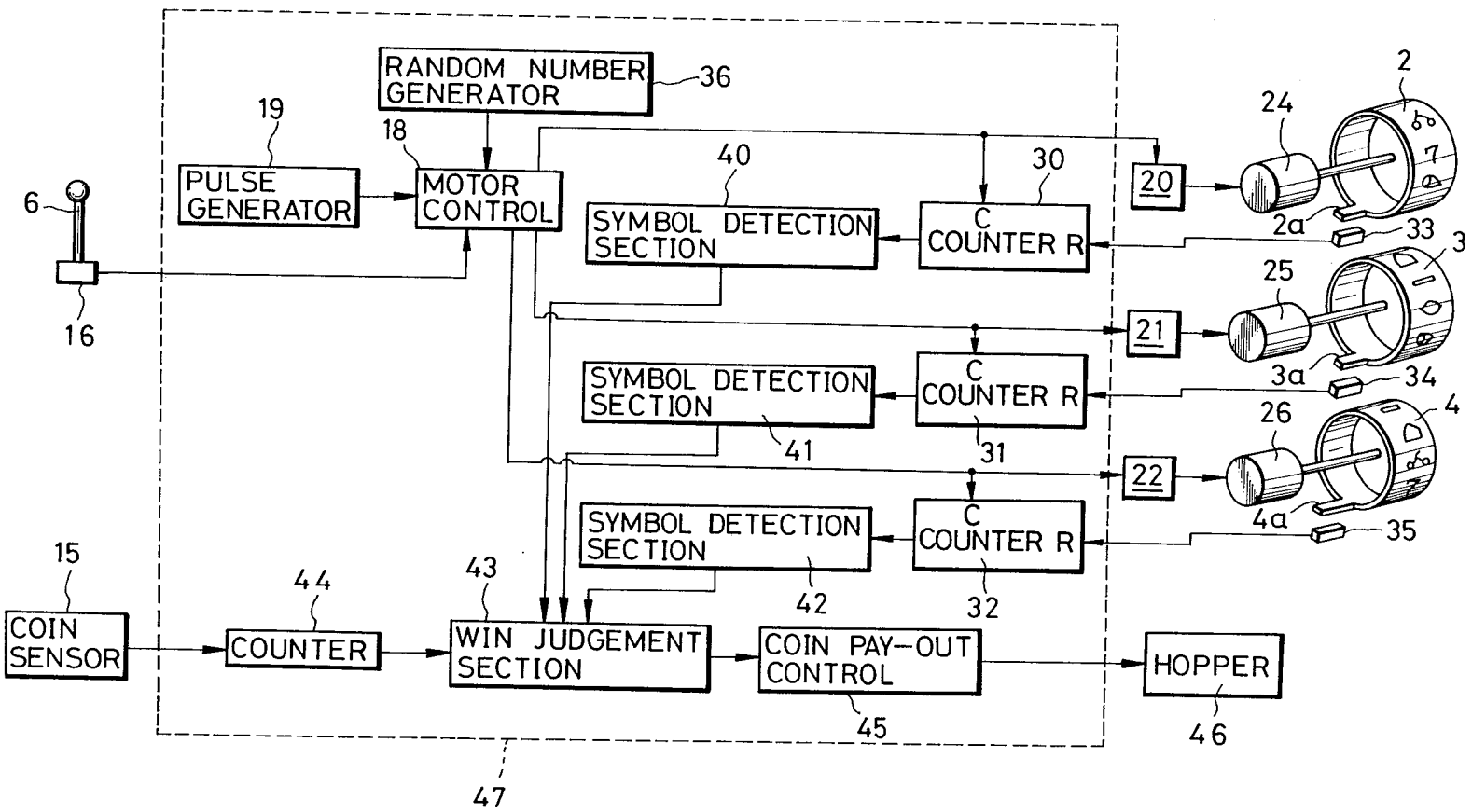
FIG. 3 is a block diagram showing a game circuit of the slot machine of FIG. 1.

The game described above is performed under the control of a system including a microcomputer 47 enclosed by a phantom line in FIG. 3. Prior to the start of the game, coins are inserted into the slot machine through the coin slot 5 and detected by a coin sensor 15 which outputs a pulse for each coin. The pulses are counted by a counter 44.

Upon pulling the start lever 6 mounted on the side of the slot machine, the motor control 18 is actuated by means of a start signal from a signal generator 16, and in turn drive pulses generated by the pulse generator 19 are supplied through the motor control 18 to motor driving sections 20 to 22, thereby driving the stepping motors 24 to 26. As a result, each reel 2 to 4 rotates and a game starts.

While each reel 2 to 4 turns by a certain angle for each pulse applied to each motor driving section 20 to 22, the drive pulses for driving the respective stepping motors 24 to 26 are cumulatively counted by respective counters 30 to 32 provided for each reel. The cumulative count value of the drive pulses is utilized in identifying the symbols on each reel as will be described in detail later. To this end, it is necessary to reset to zero the respective counters 30 to 32 each revolution of its corresponding reel. The reset pulse for this purpose is obtained by detecting the opaque lugs 2*a* to 4*a* provided on each reel 2 to 4 by means of photosensors 33 to 35 provided for each reel.

It should be noted that the numbers of pulses counted by each counter 30 to 32 have a certain relation to the respective symbols arranged on each reel associated with the counter. Thus, it can be detected based on the counted value of the counter which symbols are displayed on the winning lines.

When each reel 2 to 4 reaches a constant speed of rotation, a random number generator 36 creates random numbers and causes the motor control 18 to terminate the drive pulses thereto from the pulse generator 19 so as to stop the stepping motors 24 to 26 corresponding to the random numbers applied to the motor control 18. At this time, each counter 30 to 32 holds its counted value.

At the time all the reeds 2 to 4 stop, symbols of the respective reels stopping on the winning lines 10 and 11 are identified on the basis of the counter values in the counters 30 to 32 since the number of symbols of each reel and the number of pulses per one revolution for each reel are predetermined. On the basis of this correlation, the symbol detection sections 40, 41, 42 provide electric signals.

Since the number of symbols arranged on each reel 2, 3, 4 at regular intervals and the number of pulses required to make one revolution of each reel are predetermined, symbols for respective reels stopping on the winning lines 10, 11 can be identified on the basis of the number of pulses applied to the stepping motors 24 to 26. Specifically, when all the reels 2 to 4 stop, symbols stopping on the winning lines 10, 11 are identified by symbol detection sections 40 to 42 with reference to the counted values of drive pulses in the counters 30 to 32 related to the respective reels 2 to 4. The symbols for the respective reels 2 to 4 are transformed into electric signals and sent to a win judgment section 43.

This win judgment section 43, wherein predetermined winning combinations of symbols are stored, judges the symbols on each winning line 10, 11 as to whether the combination of three symbols on the winning line corresponds to any one of the predetermined winning combinations of symbols. It should be noted that the number of winning lines depends on the number of coins inserted into the slot machine prior to playing the game. To this end, the win judgment section 43 is adapted to select winning lines in accordance with the counter value in a coin counter 44 which receives pulses from the coin sensor 15 and counts the coins. As a result of this judgment, if in fact there is a win, the number of coins to be paid out is determined on the basis of the kind of winning combination of symbols that has occurred on the winning line and a win signal is provided and sent to a coin pay-out control 45 to control a hopper 46 so as to pay out an appropriate number of coins. The above-described operations are effected under the control of a system including the microcomputer 47.

As described above, since the reels 2 to 4 are provided with the symbol strips 12 which are shifted a half of the distance Po from each other, the reels 2 to 4 can display symbols at lengthwise different positions in the display windows 7 to 9. This shifted symbol display can be effected without any change of the motor controls for the stepping motors 24 to 26. Alternatively, it is permissible to couple the reels 2 to 4 which have the symbol strips attached at the same angular positions relative to the datum lugs 2*a* to 4*a* thereof, to the stepping motors 24 to 26 at angular positions which are different by an angle equivalent to a half of the distance Po from each other.

It is also permissible to change the motor controls for the stepping motors 24 to 26 in order to display symbols at the lengthwise shifted position. Assuming that each stepping motor 24, 25, 26 requires 200 drive pulses to make one revolution and that each reel 2, 3, 4 has 20 symbols arranged at a regular distance from each other, then ten drive pulses are required for each stepping motor 24, 25, 26 to angularly move each reel 2, 3, 4, and hence the symbols thereon, between adjacent possible stop positions. Therefore, the shifted symbol display can be accomplished by previously shifting the possible stop positions of the reels adjacent to each other by an angle equivalent to five drive pulses.

Figure 4:
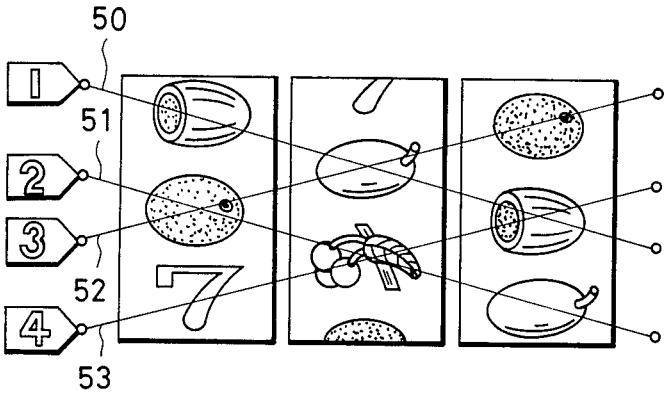
FIG. 4 is an explanatory view showing a part of the slot machine of another embodiment of the present invention.

FIG. 4 shows an embodiment in which four prize-winning lines 50 to 53 are available. This can be easily achieved either by reducing the distance from each other at which symbols are regularly arranged on each reel, or by enlarging each display window enough to display at least three symbols.

What is claimed is:

1. A slot machine in which combinations of symbols are selected on predetermined prize-winning lines in the play of a game, said slot machine comprising:

a plurality of lengthwise movable symbol rows arranged side by side, each said symbol row having various symbols arranged lengthwise at a regular spacing;

means for allowing at least one complete symbol of each said symbol row to be displayed therein;

means for causing said symbol rows to move lengthwise;

means for stopping said symbol rows to position all said symbols of said symbol rows that are adjacent to each other relatively shifted lengthwise of the rows by a half of said spacing; and means for paying out a predetermined number of coins when a prize-winning combination of said displayed complete symbols is displayed on at least one predetermined prize-winning line extending diagonally to said lengthwise arrangement of symbols.

2. A slot machine as defined in claim 1, wherein each said symbol row is provided on the outer periphery of a reel which is rotated by a stepping motor.

3. A slot machine as defined in claim 2, wherein said display means is windows provided in a front panel of said slot machine, there being one window for each reel, so as to allow visual observations of said symbols.

4. A slot machine as defined in claim 3, wherein said each window is wide enough to allow three complete symbols to be displayed.

5. A slot machine as defined in claim 1, wherein said plurality of lengthwise movable symbol rows is at least three in number.

* * * * *